US005813564A

United States Patent [19]

Luo

[11] Patent Number: 5,813,564

[45] Date of Patent: Sep. 29, 1998

[54] COVER STRUCTURE FOR AN AIRTIGHT CONTAINER

[76] Inventor: Yi-Wen Luo, 58, Ma Yuan West St., Taichung, Taiwan

[21] Appl. No.: 951,053

[22] Filed: Oct. 15, 1997

[51] Int. Cl.[6] ..... B05D 81/26

[52] U.S. Cl. ..... 220/522; 220/256; 220/300; 206/204

[58] Field of Search ..... 220/501, 503, 220/505, 521, 522, 523, 526, 529, 254, 256, 293, 295, 297, 298, 300, 367.1; 215/261, 227, 228, 231, 341, 347; 206/204

[56] References Cited

U.S. PATENT DOCUMENTS

| | | | |
|---|---|---|---|
| 2,317,882 | 4/1943 | Boesel | 206/204 X |
| 2,446,361 | 8/1948 | Cibbon | 206/204 X |
| 2,690,946 | 10/1954 | Roehrl | 206/204 |
| 2,690,947 | 10/1954 | Roehrl | 206/204 |
| 2,812,231 | 11/1957 | Zar | 206/204 X |
| 2,912,138 | 11/1959 | Bishop | 220/521 X |
| 3,918,578 | 11/1975 | Cullen et al. | 206/204 |
| 4,319,679 | 3/1982 | Gustafsson | 206/204 X |
| 4,394,144 | 7/1983 | Aoki | 206/204 X |

FOREIGN PATENT DOCUMENTS

| | | | |
|---|---|---|---|
| 4327155 | 11/1992 | Japan | 206/204 |

*Primary Examiner*—Allan N. Shoap
*Assistant Examiner*—Nathan Newhouse

[57] ABSTRACT

Disclosed is a cover structure for an airtight container and mainly includes a convex round top plate having a downward projected bottom flange around an outer periphery thereof, a middle annular member defining a central opening and having an upward projected wall around the central opening for fitly abutting on an inner surface of the bottom flange of the top plate, a round box defining an upward open space for positioning desiccative packages therein and having equally spaced vents formed on a bottom thereof, and an elastic silicone seal ring put beneath the middle annular member and around the desiccative box. The upward projected wall of the middle annular member is provided along an inner surface with equally spaced guide ways each of which has a retaining block located at a lower middle point thereof. The desiccative box is provided along its upper outer periphery with radially outward projection corresponding to the guide ways on the middle annular member. When the desiccative box is upward extended into the middle annular member with the outward projections separately aligned with and atop the retaining blocks, the desiccative box is detachably connected to and below the middle annular member.

1 Claim, 3 Drawing Sheets

COVER STRUCTURE FOR AN AIRTIGHT CONTAINER

BACKGROUND OF THE INVENTION

The present invention relates to a cover structure for an airtight container, and more particularly to an airtight container cover structure which provides a space for desiccative, so that articles in the container may be actually isolated from atmosphere and stored in a properly dried condition.

SUMMARY OF THE INVENTION

A primary object of the present invention is to provide a cover structure for an airtight container which enables an absolute isolation of articles in the container from external atmosphere and an complete removal of moisture from inside of the container.

Another object of the present invention is to provide a cover structure for an airtight container which provides a separate space for desiccative, so that the desiccative is not directly put in the container along with the stored articles. The desiccative is positioned in a separate desiccative box which is removably attached to underside of a top portion of the cover structure. A plurality of vents are formed on a bottom of the desiccative box, allowing the desiccative to absorb moistures in the container via these vents.

BRIEF DESCRIPTION OF THE DRAWINGS

The structural features and the technical means of the present invention can be best understood by referring to the following detailed description of the preferred embodiments and the accompanying drawings, wherein.

DETAILED DESCRIPTION OF THE PREFERRED EMBODIMENTS

Figure 1:
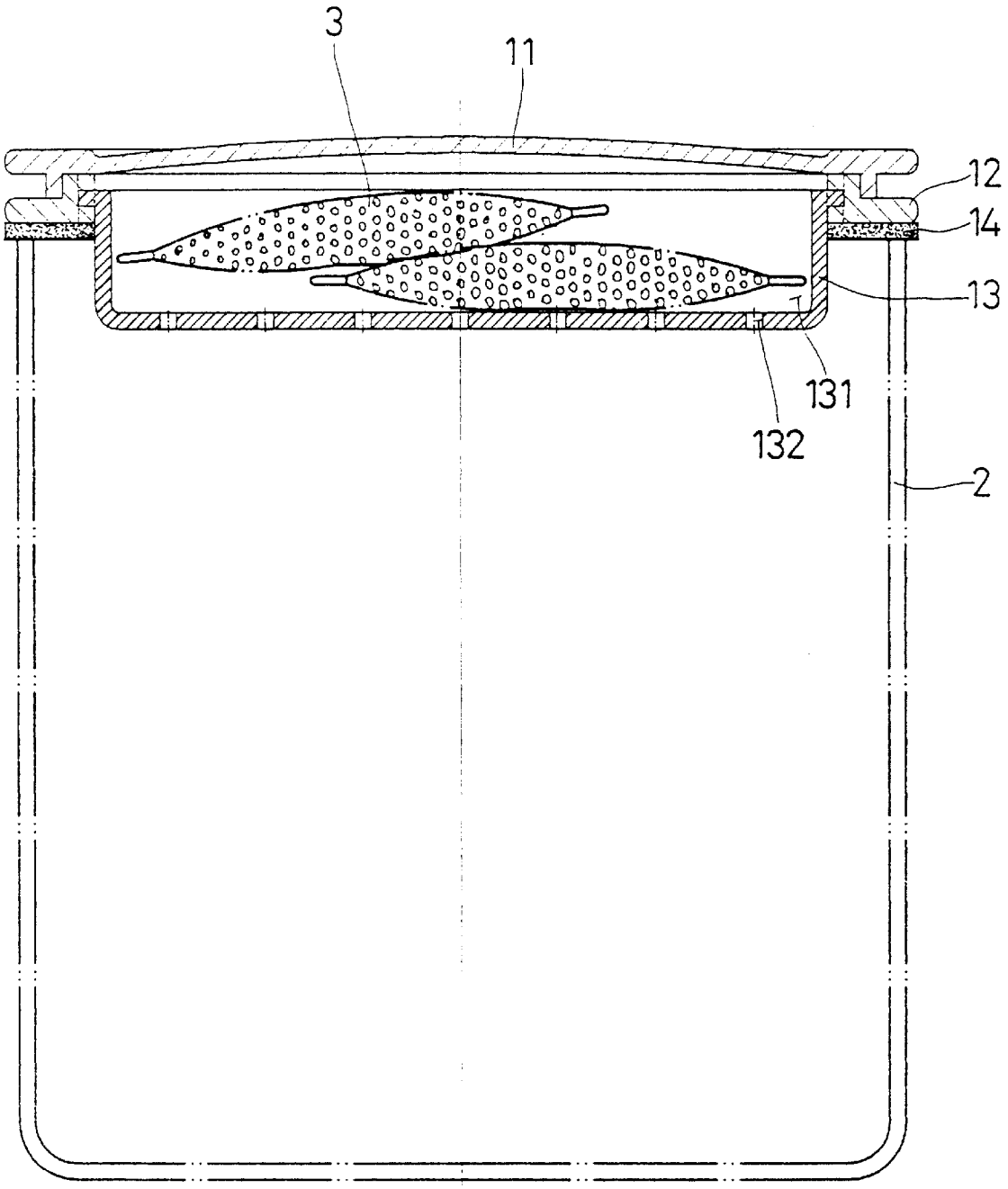
FIG. 1 illustrates a container airtightly covered with a cover according to the present invention.
Figure 2:
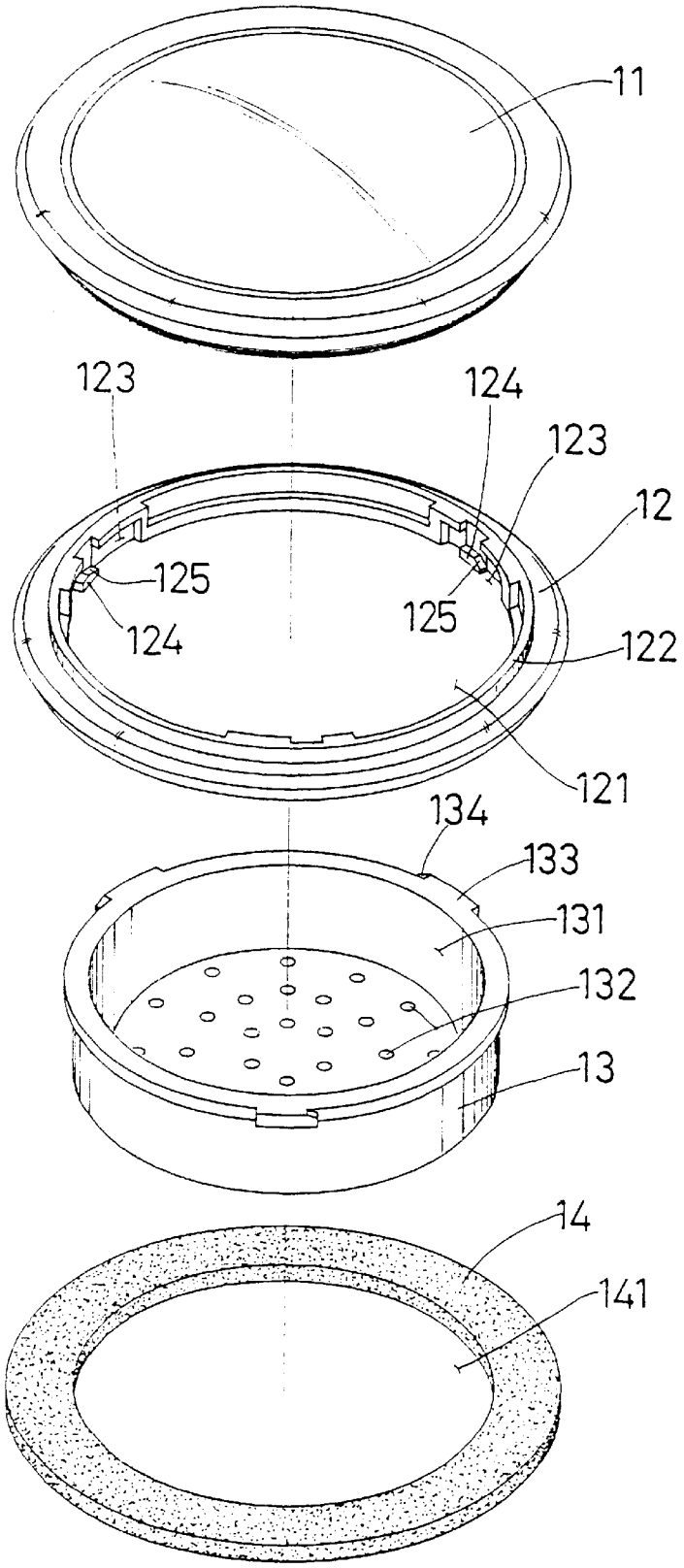
FIG. 2 is an exploded perspective of the cover shown in FIG. 1.
Figure 3:
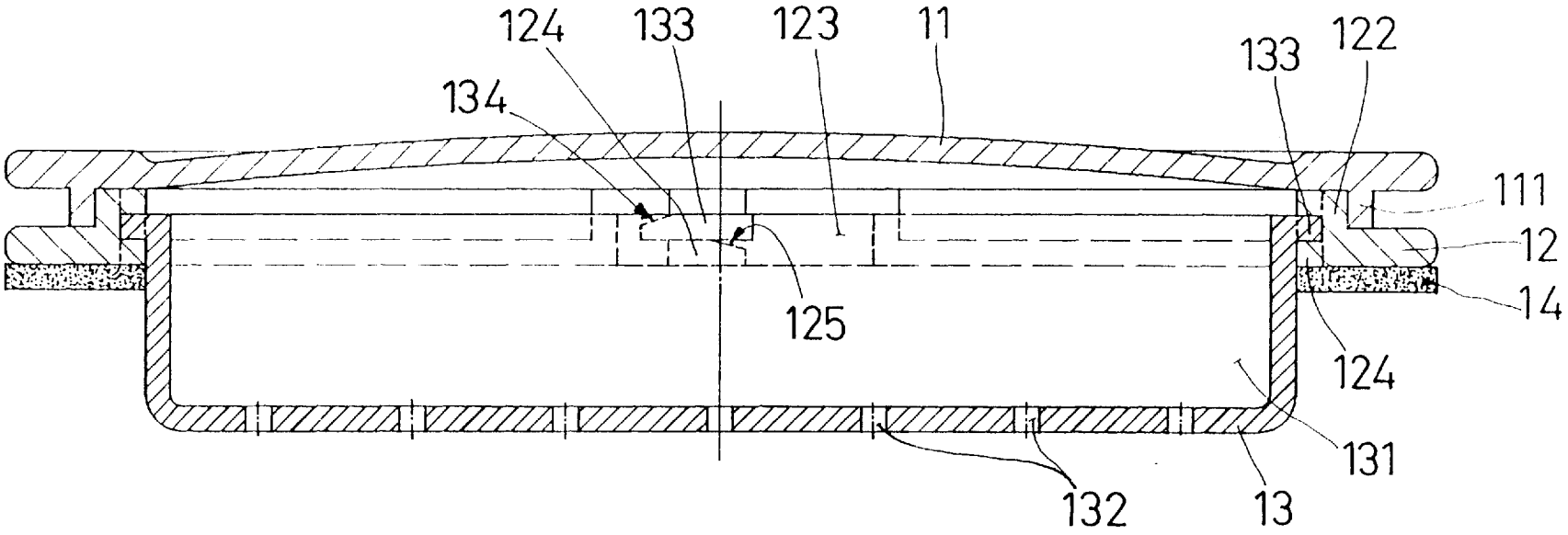
FIG. 3 is an assembled sectional view of the cover of FIG. 2.

Please refer to FIGS. 1 to 3. The present invention relates to a cover structure 1 for airtightly closing a container 2. The cover structure 1 mainly includes a top plate 11, a middle annular member 12, a desiccative box 13, and a silicone seal ring 14.

The top plate 11 is a slightly convex round member and is formed at a bottom surface with a downward projected flange 111 extending along an outer periphery of the top plate 11.

The middle annular member 12 defines a central opening 121 for the desiccative box 13 to upward extend thereinto. An upward projected wall 122 extends along a circumference of the central opening 121. A plurality of n-shaped guide ways 123 are formed and equally spaced along an inner surface of the wall 122. A retaining block 124 is provided in each guide way 123 near a lower middle point thereof. A top right corner of each retaining block 124 forms a first bevelled guiding surface 125.

The desiccative box 13 is an upward open container defining a round inner space 131 for positioning desiccative packages 3 therein. A plurality of equally spaced vents 132 are formed on a bottom surface of the box 13. A plurality of radially outward projections 133 are formed along an upper outer periphery of the box 13 corresponding to the guide ways 123 on the middle annular member 12. A top left corner of each projection 133 forms a second bevelled guiding surface 134.

The silicone seal ring 14 is an elastic annular member defining a central opening 141 for a lower portion of the desiccative box 13 to extend through.

To assemble the cover structure of the present invention, first engage the top plate 11 with the middle annular member 12 by abutting an inner circumferential surface of the flange 111 on an outer circumferential surface of the wall 122. Then, position desiccative packages 3 in the inner space 131 of the box 13 and guide the box 13 upward to extend into the middle annular member 12 with projections 133 on the box 13 separately located in the guide ways 123 of the middle annular member 12. Turn the box 13 to locate the projections 133 above the retaining blocks 124, so that the projections 133, and accordingly the whole box 13, are connected to and below the middle annular member 12 by the retaining blocks 124. Finally, put the silicone seal ring 14 around the box 13 and beneath the middle annular member 12 to complete the assembling of the cover according to the present invention.

When the present invention is used to close a container 2 as shown in FIG. 1, it ensures an inner space of the container 2 to be completely isolated from an external environment. Moreover, desiccative packages 3 positioned in the box 13 absorb moistures in the container 2 via the vents 132 formed on the bottom of the box 13, so that contents of the container 2 are always stored in a properly dried space. The silicone seal ring 4 ensures an airtight condition of the container 2 to effectively maintain the contents of the container 2 in a fresh state for a prolonged time.

Since the box 13 is detachably assembled to the middle annular member 12, it can be removed from the middle annular member 12 for replacement of invalid desiccative packages 3 with new and valid ones. And, the box 13 with replenished desiccative packages 3 is assembled to the middle annular member 12 again, so that the cover structure 1 of the present invention may always airtightly close the container 2 while ensures a suitably dried internal space of the container 2.

What is claimed is:

1. A cover structure for an airtight container, comprising a top plate, a middle annular member, a desiccative box, and a silicone seal ring;

said top plate being a slightly convex round member and being formed at a bottom surface with a downward projected flange extending along an outer periphery of said top plate;

said middle annular member defining a central opening for said desiccative box to upward extend thereinto, an upward projected wall extending along a circumference of said central opening, a plurality of n-shaped guide ways being formed and equally spaced along an inner surface of said wall, a retaining block being provided in each said guide way near a lower middle point thereof, and a top right corner of each said retaining block forming a first bevelled guiding surface; whereby said middle annular member being engaged with said top plate by abutting an outer circumferential surface of said upward projected wall on an inner circumferential surface of said bottom flange of said top plate;

said desiccative box being an upward open container defining a round inner space for positioning desiccative packages therein, a plurality of equally spaced vents being formed on a bottom surface of said box, a plurality of radially outward projections being formed along an upper outer periphery of said box corresponding to said guide ways on said middle annular member, a top left corner of each said projection forming a second bevelled guiding surface;

whereby said desiccative box is detachably assembled to said middle annular member by engaging said projections into said guide ways on said middle annular member while positioning said projections above said retaining blocks in said guide ways; and said silicone seal ring being an elastic annular member defining a central opening for a lower portion of said desiccative box to extend through, and said silicone seal ring being put beneath said middle annular member and around said desiccative box.

* * * * *